US010213912B2

(12) United States Patent
Kumagai et al.

(10) Patent No.: US 10,213,912 B2
(45) Date of Patent: Feb. 26, 2019

(54) IMPACT TOOL

(71) Applicant: MAKITA CORPORATION, Anjo-shi, Aichi (JP)

(72) Inventors: Ryunosuke Kumagai, Anjo (JP); Tokuo Hirabayashi, Anjo (JP)

(73) Assignee: MAKITA CORPORATION, Anjo-shi (JP)

( * ) Notice: Subject to any disclaimer, the term of this patent is extended or adjusted under 35 U.S.C. 154(b) by 1005 days.

(21) Appl. No.: 14/320,980

(22) Filed: Jul. 1, 2014

(65) Prior Publication Data

US 2015/0041169 A1 Feb. 12, 2015

(30) Foreign Application Priority Data

Aug. 8, 2013 (JP) ..... 2013-165402

(51) Int. Cl.

| | |
|---|---|
| ***B25D 17/00*** | (2006.01) |
| ***B25D 17/26*** | (2006.01) |
| ***B25D 11/04*** | (2006.01) |
| ***B25B 21/02*** | (2006.01) |

(52) U.S. Cl.

CPC ..... *B25D 17/26* (2013.01); *B25B 21/026* (2013.01); *B25D 11/04* (2013.01)

(58) Field of Classification Search

CPC ..... B25D 11/04; B25B 21/026
USPC ..... 173/93
See application file for complete search history.

(56) References Cited

U.S. PATENT DOCUMENTS

| | | | | |
|---|---|---|---|---|
| 2,220,711 | A | 11/1940 | Fitch | |
| 3,001,428 | A | 9/1961 | Sindelar | |
| 7,308,948 | B2 * | 12/2007 | Furuta | B25B 21/00 173/178 |
| 9,643,300 | B2 * | 5/2017 | Kumagai | B25B 21/026 |
| 2005/0173139 | A1 * | 8/2005 | Furuta | B25B 21/00 173/48 |
| 2006/0180327 | A1 * | 8/2006 | Nagasaka | B25B 21/02 173/128 |
| 2010/0200257 | A1 * | 8/2010 | Scrimshaw | B23B 31/1238 173/47 |
| 2012/0000683 | A1 * | 1/2012 | Nagasaka | B25B 21/026 173/93.5 |
| 2012/0118596 | A1 | 5/2012 | Scott | |

FOREIGN PATENT DOCUMENTS

| | | |
|---|---|---|
| DE | 12 74 048 B | 7/1968 |
| JP | S49-95599 U | 8/1974 |
| JP | S51-145711 U | 11/1976 |

(Continued)

OTHER PUBLICATIONS

Jan. 24, 2017 Office Action issued in Japanese Patent Application No. 2016-230881.

(Continued)

*Primary Examiner* — Chelsea E Stinson
(74) *Attorney, Agent, or Firm* — Oliff PLC

(57) ABSTRACT

An impact driver includes a motor, a spindle rotated by the motor, a hammer that is movable forward and rearward with respect to the spindle and that has an inner peripheral portion facing the spindle, and an anvil struck in a rotational direction by the hammer. A grease supply path is provided to supply grease to the inner peripheral portion of the hammer.

16 Claims, 14 Drawing Sheets

(56) References Cited

FOREIGN PATENT DOCUMENTS

| | | | |
|---|---|---|---|
| JP | H07-40258 | A | 2/1995 |
| JP | 2010-201543 | A | 9/2010 |
| JP | 2012-006101 | A | 1/2012 |
| JP | 2012-011533 | A | 1/2012 |
| JP | A-2013-119149 | | 6/2013 |

OTHER PUBLICATIONS

Dec. 20, 2016 Office Action issued in Japanese Patent Application No. 2016-230881.
Nov. 22, 2016 Office Action issued in Japanese Patent Application No. 2013-165402.
Nov. 2, 2016 Office Action issued in German Patent Application No. 10 2014 011 701.4.
Mar. 14, 2017 Office Action issued in Japanese Patent Application No. 2013-165402.
May 23, 2018 Office Action issued in Japanese Patent Application No. 2017-113726.

* cited by examiner

IMPACT TOOL

BACKGROUND OF THE INVENTION

This application claims the benefit of Japanese Patent Application Number 2013-165402 filed on Aug. 8, 2013, the entirety of which is incorporated by reference.

FIELD OF THE INVENTION

The present invention relates to an impact tool in which a rotational impact force can be applied to an anvil holding a bit with a hammer.

DESCRIPTION OF RELATED ART

In an impact tool, as described in Japanese Patent Application Publication No. 2013-119149 (JP 2013-119149 A), a hammer is coupled to a spindle, to which rotation is transferred from a motor, via balls, and the hammer is engaged with an anvil, to which a bit is mounted, by a coil spring externally mounted to the spindle. Thus, a rotational impact force (impact) is intermittently generated by engaging and disengaging the hammer with and from the anvil in accordance with an increase in torque applied to the anvil.

In such an impact tool, grease is contained in a hammer case housing the impact mechanism to lubricate various components of the impact tool.

In the conventional impact tool as disclosed above, the hammer is slid in an axial direction along the spindle when an impact is generated. This may remove grease between an outer peripheral portion of the spindle and an inner peripheral portion of the hammer, so that lubricity may be lost.

SUMMARY OF THE INVENTION

An object of the present invention is to provide an impact tool in which grease can be reliably supplied to an inner peripheral portion of a hammer to maintain good lubricity.

In order to achieve the foregoing object, according to a first aspect of the present invention, an impact tool includes a motor, a spindle rotated by the motor, a hammer that is movable forward and rearward with respect to the spindle and that has an inner peripheral portion facing the spindle, and an anvil struck in a rotational direction by the hammer. In the impact tool, a grease supply path is provided to supply grease to the inner peripheral portion of the hammer.

In order to achieve the foregoing object, according to a second aspect of the present invention, an impact tool includes a motor, a pinion driven by the motor, a spindle rotated by the motor and having a hole in which the pinion is disposed, a hammer that is movable forward and rearward with respect to the spindle and that has an inner peripheral portion facing the spindle, and an anvil struck in a rotational direction by the hammer. In the impact tool, the hole of the spindle and the inner peripheral portion of the hammer are communicated with each other so that grease can be supplied to the inner peripheral portion.

In order to achieve the foregoing object, according to a third aspect of the present invention, an impact tool includes a motor, a spindle rotated by the motor, a hammer that is movable forward and rearward with respect to the spindle and that has an inner peripheral portion facing the spindle, and an anvil disposed in front of the hammer and struck in a rotational direction by the hammer. In the impact tool, a bottomed hole is provided in a front portion of the spindle, and the inner peripheral portion of the hammer and the bottomed hole of the spindle are communicated with each other so that grease can be supplied to the inner peripheral portion.

In order to achieve the foregoing object, according to a fourth aspect of the present invention, an impact tool includes a motor, a spindle rotated by the motor, a hammer that is movable forward and rearward with respect to the spindle and that has an inner peripheral portion facing the spindle, and an anvil struck in a rotational direction by the hammer. In the impact tool, a hole portion is provided in the hammer, and the inner peripheral portion of the hammer and the hole portion of the hammer are communicated with each other so that grease can be supplied to the inner peripheral portion.

In order to achieve the foregoing object, according to a fifth aspect of the present invention, an impact tool includes a motor, a pinion driven by the motor, a spindle rotated by the motor and that has a bottomed hole in which the pinion is disposed, a hammer that is movable forward and rearward with respect to the spindle and that has an inner peripheral portion facing the spindle, and an anvil that is struck in a rotational direction by the hammer and that has a fitting portion fitted with the spindle. In the impact tool, the bottomed hole of the spindle and the fitting portion of the anvil are communicated with each other so that grease is movable between the bottomed hole and the fitting portion.

According to the present invention, it is possible to reliably supply grease to the inner peripheral portion of a hammer to maintain good lubricity.

BRIEF DESCRIPTION OF THE DRAWINGS

FIGS. 11A and 11B illustrate an example of a washer holding structure according to a modification, in which FIG. 11A illustrates a vertical section of a front end portion and FIG. 11B illustrates a cross-sectional view taken along line C-C in FIG. 11A.

FIGS. 12A and 12B illustrate an example of a washer holding structure according to a modification, in which FIG. 12A illustrates a vertical section of a front end portion and FIG. 12B illustrates a cross-sectional view taken along line D-D in FIG. 12A.

DETAILED DESCRIPTION OF THE EMBODIMENTS

An embodiment of the present invention will be described below with reference to the drawings.

Figure 1:
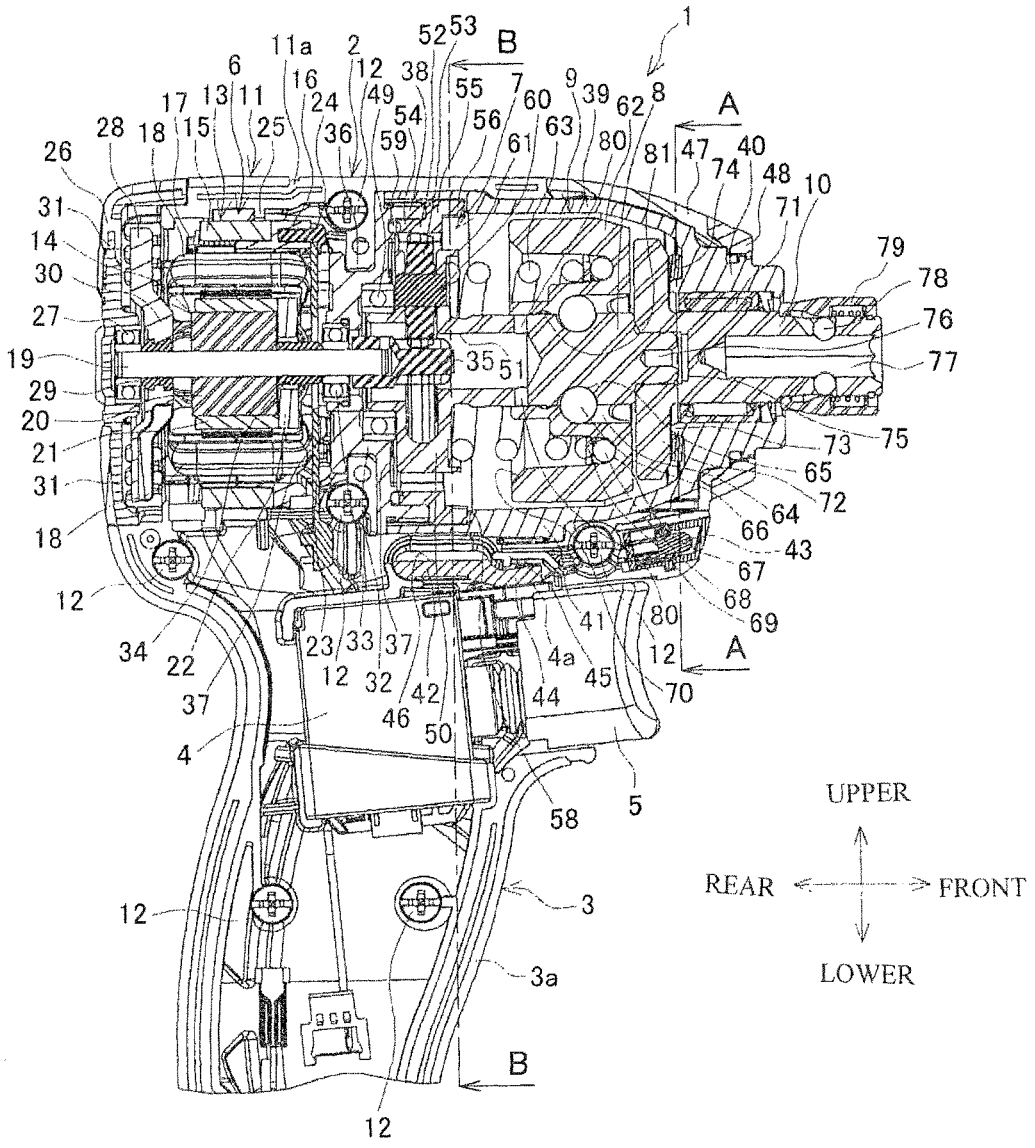
FIG. 1 is a partial vertical sectional view of an impact driver.
Figure 2:
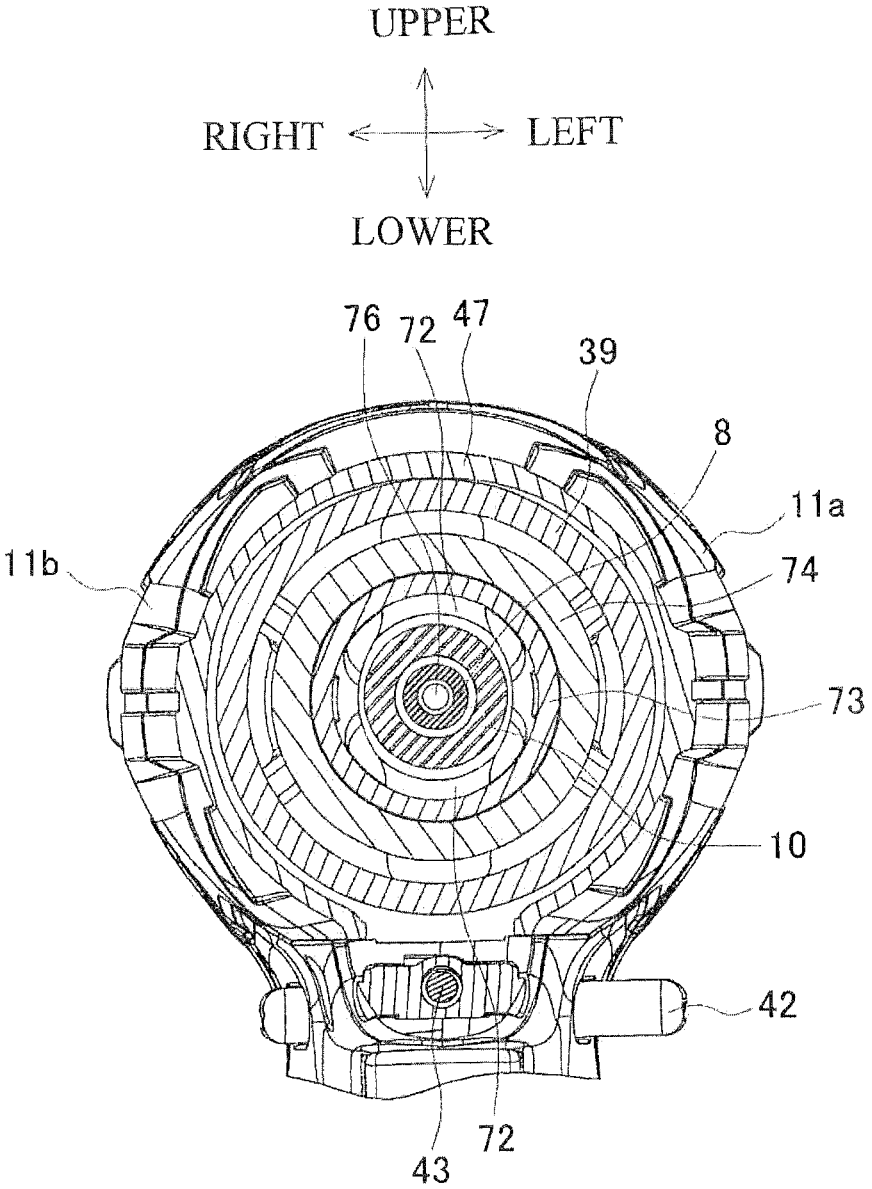
FIG. 2 is a cross-sectional view taken along line A-A in FIG. 1.
Figure 3:
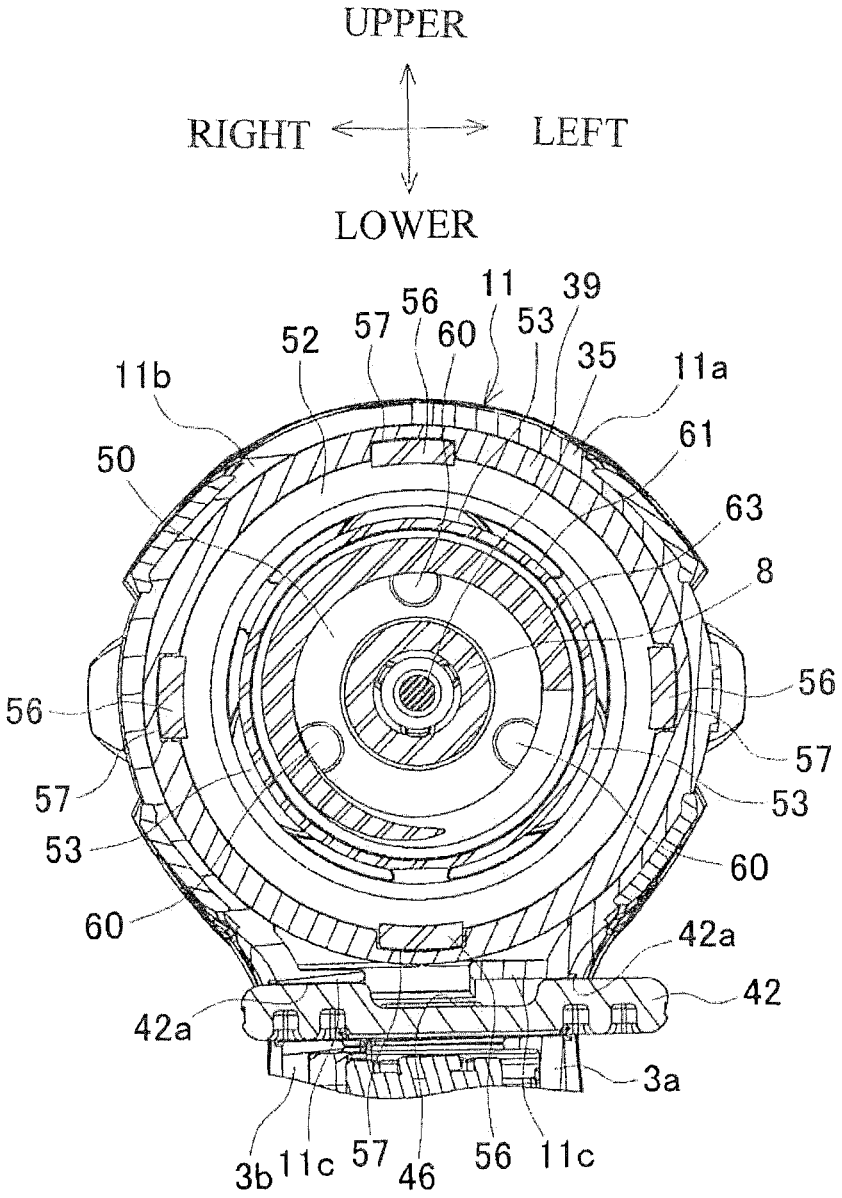
FIG. 3 is a cross-sectional view taken along line B-B in FIG. 1.

FIG. 1 is a partial vertical sectional view of an impact driver as an example of an impact tool. FIG. 2 is a cross-sectional view taken along line A-A in FIG. 1. FIG. 3 is a cross-sectional view taken along line B-B in FIG. 1. An impact driver 1 includes a body portion 2 with the center axis extending in the front-rear direction (with the right side of FIG. 1 defined as a front side), and a grip portion 3 projecting downward from the body portion 2. A battery pack serving as a power source is mounted to an attachment portion (not illustrated) provided at a lower end of the grip portion 3. A switch 4 with a trigger 5 projecting forward is housed in an upper portion of the grip portion 3.

The body portion 2 houses a motor 6, a planetary gear speed reduction mechanism 7, a spindle 8, and an impact mechanism 9, which are arranged in this order from a rear side of the body portion 2. An anvil 10 projects forward from a front end of the body portion 2. The body portion 2 has a body housing 11 formed by assembling a pair of left and right half housings 11*a* and 11*b* illustrated in FIG. 3 to each other using a plurality of screws 12. The motor 6 is housed in a rear portion of the body housing 11. The grip portion 3 is also formed by assembling a pair of left and right grip housings 3*a* and 3*b* to each other using a plurality of screws 12. The grip housings 3*a* and 3*b* are formed integrally with the half housings 11*a* and 11*b*, respectively.

The motor 6 is an inner-rotor brushless motor having a stator 13 and a rotor 14. The stator 13 has a stator core 15, a front insulating member 16 and a rear insulating member 17 provided in front and rear of the stator core 15, respectively. A plurality of coils 18 are wound around the stator core 15 via the front insulating member 16 and the rear insulating member 17. The rotor 14 has a rotary shaft 19 positioned on an axis of the rotor 14, a tubular rotor core 20 disposed around the rotary shaft 19, a permanent magnet 21 that is disposed on an outer side of the rotor core 20 and that is tubular and has alternate polarities in a circumferential direction, and a plurality of sensor permanent magnets 22 disposed radially on a front side of the permanent magnet 21. A sensor circuit substrate 23 is fixed to a front end of the front insulating member 16 by a screw 24. Three rotation detection elements (not illustrated) that detect a position of the sensor permanent magnets 22 of the rotor 14 to output a rotation detection signal are mounted on the sensor circuit substrate 23. Terminals of the coils 18 are electrically connected to the sensor circuit substrate 23 in the penetrating state. Switching elements that switch the coils 18 are mounted on a control substrate (not illustrated) provided inside the attachment portion for the battery pack.

The stator 13 is held coaxially with the body portion 2 by a rib 25 projecting from an inner surface of the body housing 11. A cap-shaped rear housing 26 is attached to a rear surface of the body housing 11 from a rear side thereof by a screw (not illustrated). A rear end of the rotary shaft 19 is rotatably supported by a bearing 27 held by the rear housing 26. 28 denotes a centrifugal fan for motor cooling attached to the rotary shaft 19 via an insert bush 29 made of metal in front of the bearing 27. A center portion of the centrifugal fan 28 is formed as a swelling portion 30 that swells forward in a mortar shape. The bearing 27 is disposed right behind the swelling portion 30 so as to overlap the centrifugal fan 28. Discharge ports 31 are formed in a side surface of the rear housing 26, and positioned on a radially outer side of the centrifugal fan 28. A suction port (not illustrated) is formed in the side surface of the body housing 11 on a radially outer side of the sensor circuit substrate 23.

A front end of the rotary shaft 19 penetrates a bearing retainer 32 held by the body housing 11 in front of the motor 6 to project forward, and is rotatably supported by a bearing 33 held by a rear portion of the bearing retainer 32. A sleeve 34 externally is mounted to the rotary shaft 19 between the rotor core 20 and the bearing 33, and a pinion 35 is attached to the front end of the rotary shaft 19.

The bearing retainer 32 is made of metal, and has a disc shape in which a constricted portion is formed at a middle part of the bearing retainer 32 in the front-rear direction. The bearing retainer 32 is held by the body housing 11 such that movement of the bearing retainer 32 in the front-rear direction is restrained with a rib 36 that is provided on the inner surface of the body housing 11 and fitted in the constricted portion. Dented portions 37 for heat radiation are formed in each front and rear surfaces of the bearing retainer 32.

A ring wall 38 having an outer periphery on which a male thread portion is formed is provided to project forward at a peripheral edge of the front surface of the bearing retainer 32. A hammer case 39 housing the spindle 8 and the impact mechanism 9 has a female thread portion which is coupled to the ring wall 38. The hammer case 39 is a tubular member made of metal. The front half of the hammer case 39 is tapered to form a front tube portion 40. The female thread portion formed on an inner periphery at a rear end of the hammer case 39 is screwed with the male screw portion of the ring wall 38 so that a rear portion of the hammer case 39 is blocked by the bearing retainer 32 serving as a lid. A projection 41 is formed on a lower surface of the hammer case 39. In the assembled state, a pushing rib (not illustrated) projecting from an inner surface of the left and right half housings 11*a* and 11*b* abuts against a side surface of the projection 41. A projecting streak (not illustrated) is formed on left and right side surfaces of the hammer case 39. The projecting streak is fitted in a recessed groove (not illustrated) formed in the inner surface of the half housings 11*a* and 11*b*. Rotation of the hammer case 39 is restrained by engagement between the projection 41 and the pushing rib and between the projecting streak and recessed groove.

A forward/reverse switching lever 42 for the motor 6 is provided between the hammer case 39 and the switch 4 so as to be slidable leftward and rightward. An LED 43 that irradiates a location ahead of the anvil 10 is attached in front of the forward/reverse switching lever 42 to be directed obliquely upward. An engagement projection 44 for engagement with a switching lever 4*a* provided on an upper surface of the switch 4 is formed at the center of a front surface of the forward/reverse switching lever 42. A pushing piece 45 projecting from the half housing 11*a* is positioned above the engagement projection 44. Leftward and rightward slide of the engagement projection 44 is guided with an upper surface of the engagement projection 44 and a lower end of the pushing piece 45 contacting each other. A center portion of the forward/reverse switching lever 42 is thin-walled with a notched portion 46 formed in an upper surface of the forward/reverse switching lever 42. A guide portion 11*c* on which left and right upper surfaces 42*a* of the forward/reverse switching lever 42 excluding the notched portion 46 slide is formed on the half housings 11*a* and 11*b*.

Further, a cover 47 is provided in front of the body housing 11 to cover a front part to the front tube portion 40 of the hammer case 39. A bumper 48 made of rubber is mounted to an outer peripheral portion at a front end of the cover 47.

Figure 4:
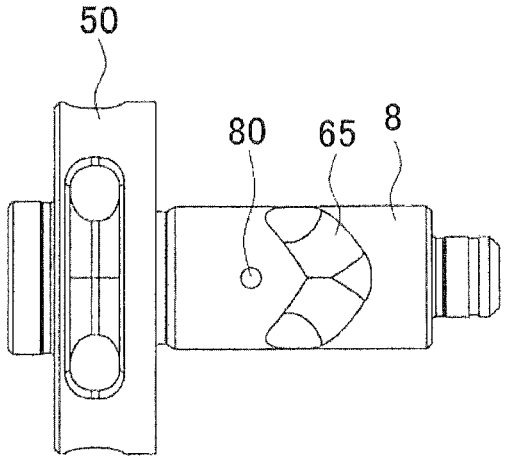
FIG. 4 is a plan view of a spindle.

A bearing 49 is held by a front portion of the bearing retainer 32. A rear end of the spindle 8 is rotatably supported by the bearing 49. As also illustrated in FIG. 4, the spindle 8 has a hollow and disc-shaped carrier portion 50 provided at a rear portion of the spindle 8. The front end of the rotary shaft 19 and the pinion 35 are projected into a bottomed hole 51 (which may also be a through hole) formed on an axis of the spindle 8 from a rear surface thereof.

The planetary gear speed reduction mechanism 7 includes an internal gear 52 that has inner teeth, and three planetary gears 53 that have outer teeth meshed with the internal gear 52. The internal gear 52 has a gear portion 54 housed coaxially inside the ring wall 38 of the bearing retainer 32, and a front portion 55 that is provided continuously on a front outer peripheral side of the gear portion 54 and that is larger in diameter than the gear portion 54. As illustrated in FIG. 3, the front portion 55 is provided with four projected portions 56 projecting forward at equal intervals in the circumferential direction. The projected portions 56 are engaged with four recessed portions 57 formed in front of the female thread portion in an inner peripheral surface of the hammer case 39, which prevents rotation of the internal gear 52. Movement of the internal gear 52 in an axial direction is restrained such that a rear surface of the front portion 55 abuts against the ring wall 38 and a front surface of the projected portions 56 abuts against a stepped portion 58 formed on a front side of the recessed portions 57.

An O ring 59 is made of rubber and interposed between a rear end of the gear portion 54 and the front surface of the bearing retainer 32. The O ring 59 seals a gap between the internal gear 52 and the bearing retainer 32, and relieves a shock applied from the internal gear 52 to the bearing retainer 32.

The planetary gears 53 are rotatably supported in the carrier portion 50 of the spindle 8 by a pin 60 to be meshed with the pinion 35 of the rotary shaft 19. A ring-shaped rising portion 61 is formed at an outer periphery of a front part of the carrier portion 50 on an outer side of the pin 60.

The impact mechanism 9 includes a hammer 62 externally mounted to the spindle 8, and a coil spring 63 urging the hammer 62 forward. The hammer 62 has a front surface on which a pair of hooks (not shown) are provided, and is coupled to the spindle 8 via balls 66 which are fitted between outer cam grooves 64 formed on an inner surface of the hammer 62 and inner cam grooves 65 formed on an outer surface of the spindle 8. A ring-shaped groove 67 is formed in a rear surface of the hammer 62. A front end of the coil spring 63 is inserted into the groove 67. A plurality of balls 68 and a washer 69 are housed at a bottom portion of the groove 67 to receive the front end of the coil spring 63. A tapered portion 70 is formed on the outer side of the rear end of the groove 67, and expands in diameter toward the rear. The rear end of the coil spring 63 abuts against the front surface of the carrier portion 50 on the inner side of the rising portion 61.

The anvil 10 is rotatably supported by a bearing (in the embodiment, a needle bearing) 71 held by the front tube portion 40 of the hammer case 39. A pair of arms 72 are formed at a rear end of the anvil 10 to be engaged with the hooks of the hammer 62 in the rotational direction. As illustrated in FIG. 2, a ring-shaped holding portion 73 projects from an inner peripheral side of a rear surface of the front tube portion 40 in front of the arms 72. A washer 74 made of a resin is fitted on an outer side of the holding portion 73 to receive the arms 72. An arrangement of the washer 74 on a radially outer side of a rear end portion of the bearing 71 contributes to compactness. In particular, the use of a needle bearing allows a reduction in holding width for centering an axis of the anvil 10.

A fitting hole 75 serving as a fitting portion is formed on the axis in the rear surface of the anvil 10. The front end of the spindle 8 is coaxially inserted into the fitting hole 75. A front bottomed hole 76 is formed on the axis at the front end of the spindle 8. An insertion hole 77 is formed on the axis in the front surface of the anvil 10 to receive a bit (not illustrated). A chuck mechanism including balls 78, a sleeve 79 and the like is provided at the front end of the anvil 10 to retain the bit inserted into the insertion hole 77.

As also illustrated in FIG. 4, a pair of grease supply paths 80 are formed in rear of the inner cam grooves 65 to communicate with the bottomed hole 51 and open in an outer peripheral portion of the spindle 8. The grease supply paths 80 are formed orthogonally to the bottomed hole 51. With the hammer 62 at an advanced position illustrated in FIG. 1, an inner peripheral portion of the hammer 62 overlaps the openings of the grease supply paths 80 on an outer peripheral portion side of the spindle 8. A recessed groove 81 is formed to extend in the circumferential direction in the inner peripheral portion of the hammer 62. The recessed groove 81 is positioned on the outer side of the grease supply paths 80 so as not to be overlapped with each other with the hammer 62 at a retracted position when an impact is generated. Hence, the openings of the grease supply paths 80 are always positioned at the inner peripheral portion of the hammer 62 irrespective of whether the hammer 62 is moved forward or rearward.

In the impact driver 1 configured as described above, when the trigger 5 is pressed to turn on the switch 4, the motor 6 is energized to rotate the rotary shaft 19. That is, a microcomputer of a control substrate acquires the rotational state of the rotor 14 by obtaining a rotation detection signal that is output from a rotation detection element of the sensor circuit substrate 23 and that indicates a position of the sensor permanent magnet 22 of the rotor 14. Subsequently, the microcomputer controls on/off of the switching elements in accordance with the acquired rotational state of the rotor 14, and sequentially applies a current to the coils 18 of the stator 13 to rotate the rotor 14.

Then, the planetary gears 53 which are meshed with the pinion 35 revolve in the internal gear 52 to rotate the spindle 8 at a reduced speed via the carrier portion 50. Hence, the hammer 62 is also rotated to rotate the anvil 10 via engagement between the hooks and the arms 72, which enables the bit to tighten a screw. When the screw is tightened and torque of the anvil 10 increases, the hammer 62 is retracted against the urge of the coil spring 63 with the balls 66 rolled along the inner cam grooves 65 of the spindle 8. When the hooks are disengaged from the arms 72, the hammer 62 is rotated while being advanced by the urge of the coil spring 63 as guided by the inner cam grooves 65 so that the hooks are engaged with the arms 72 again, which causes the anvil 10 to generate a rotational impact force (impact). Repetition of such operations enables further tightening.

Then, grease contained in the hammer case 39 lubricates the pinion 35 and the internal gear 52, and therefore the grease is also provided in the bottomed hole 51 of the spindle 8. Hence, even if grease is removed from the outer peripheral portion of the spindle 8 when the hammer 62 is advanced and retracted along the spindle 8 when an impact is generated, new grease is supplied to an inner peripheral portion of the hammer 62 via the grease supply paths 80 from the bottomed hole 51. In particular, the recessed groove 81 of the hammer 62 makes it easy for grease to be retained in the inner peripheral portion of the hammer 62. Thus, lubrication in the inner peripheral portion of the hammer 62 is maintained even when an impact is generated.

Thus, with the impact driver 1 according to the embodiment, grease can be reliably supplied to the inner peripheral portion of the hammer 62 to maintain good lubricity by providing the grease supply paths 80 configured to supply grease to the inner peripheral portion of the hammer 62.

Figure 5:
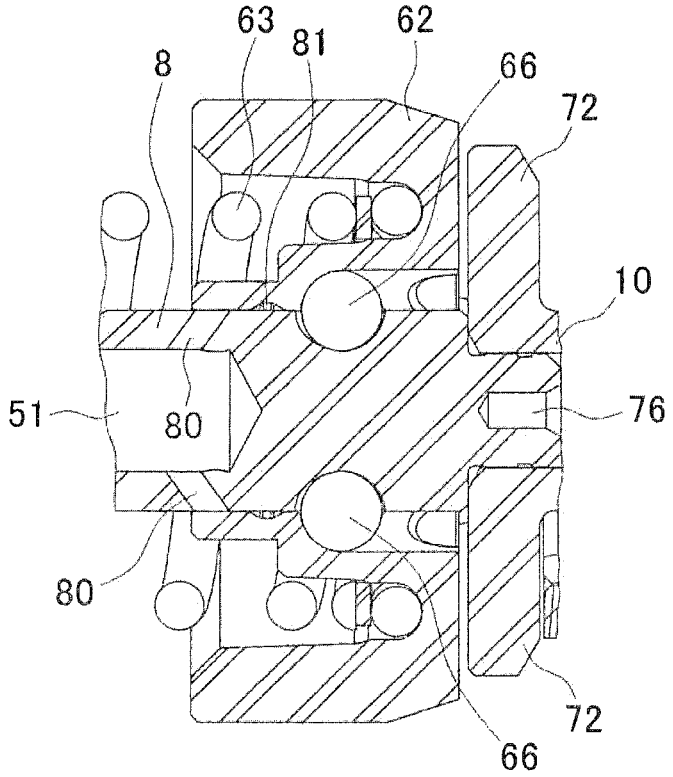
FIG. 5 illustrates an example of a grease supply path according to a modification.
Figure 6:
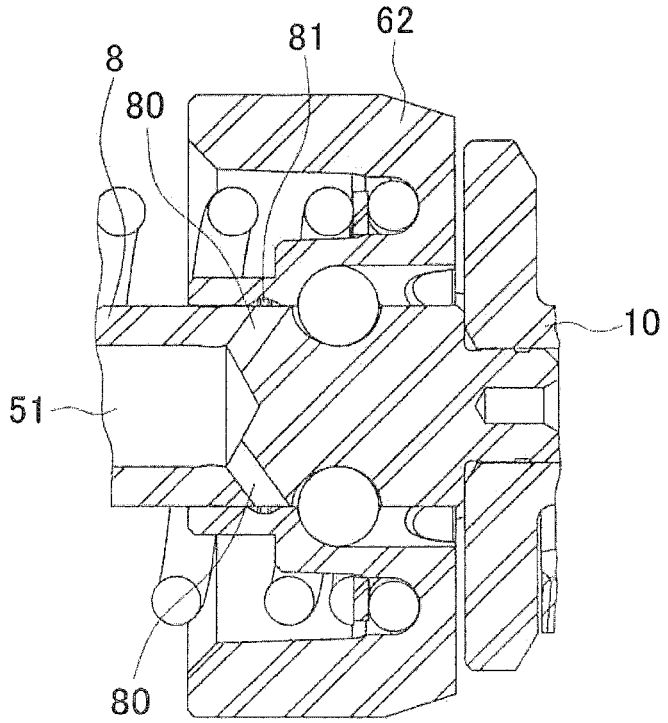
FIG. 6 illustrates an example of a grease supply path according to a modification.

In the embodiment, the grease supply paths 80 are formed orthogonally to the axis of the spindle 8. As illustrated in FIG. 5, however, the grease supply paths 80 may be formed to be inclined with respect to the axis of the spindle 8. In this case, grease is supplied little by little to the inner peripheral portion of the hammer 62 as the spindle 8 is rotated. Moreover, as illustrated in FIG. 6, the grease supply paths 80 may be formed at a position forward of that in FIG. 5 such that the openings of the grease supply paths 80 overlap a recessed groove 81 of the hammer 62 with the hammer 62 at the advanced position. Accordingly, grease is likely to accumulate in the recessed groove 81.

Figure 7:
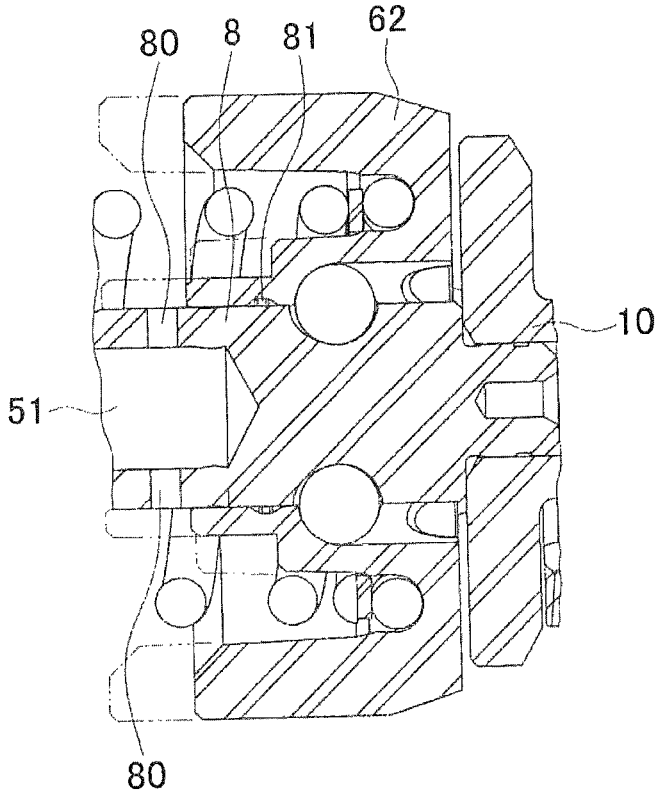
FIG. 7 illustrates an example of a grease supply path according to a modification.

The openings of the grease supply paths 80 do not necessarily overlap the inner peripheral portion of the hammer 62. As illustrated in FIG. 7, the grease supply paths 80 may be provided at a position rearward of that in FIG. 1 such that the openings of the grease supply paths 80 do not overlap the inner peripheral portion of the hammer 62 with the hammer 62 at the advanced position but overlap the inner peripheral portion with the hammer 62 at the retracted position indicated by the dash-double-dot line.

Figure 8:
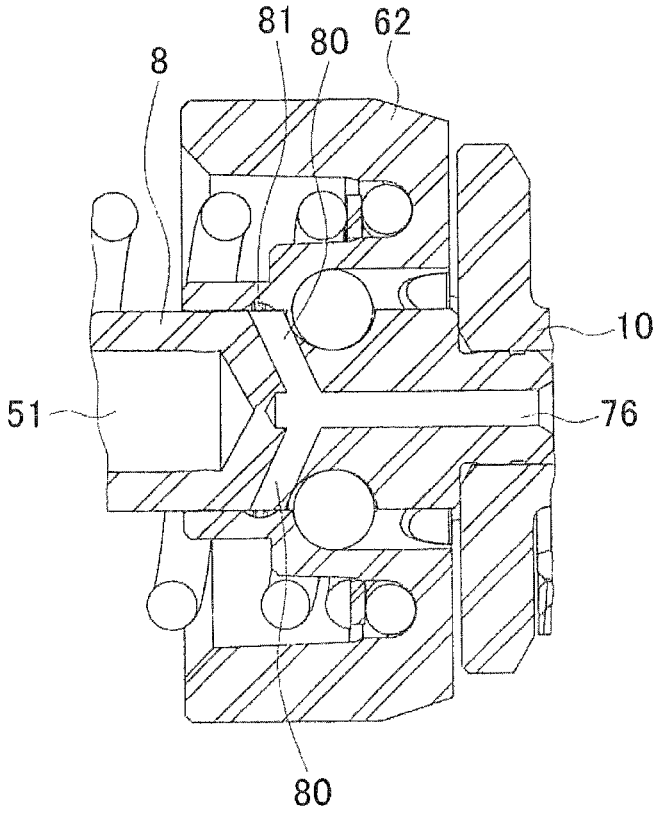
FIG. 8 illustrates an example of a grease supply path according to a modification.

Further, the grease supply paths 80 are not necessarily formed to extend from the bottomed hole 51 of the spindle 8. As illustrated in FIG. 8, the front bottomed hole 76 of the spindle 8 may be extended rearward, and the grease supply paths 80 may be formed in an inclined manner to extend from the front bottomed hole 76 such that the openings of the grease supply paths 80 face the inner peripheral portion of the hammer 62. This allows grease for lubrication of the anvil 10 and the spindle 8 to be supplied to the inner peripheral portion of the hammer 62.

Figure 9:
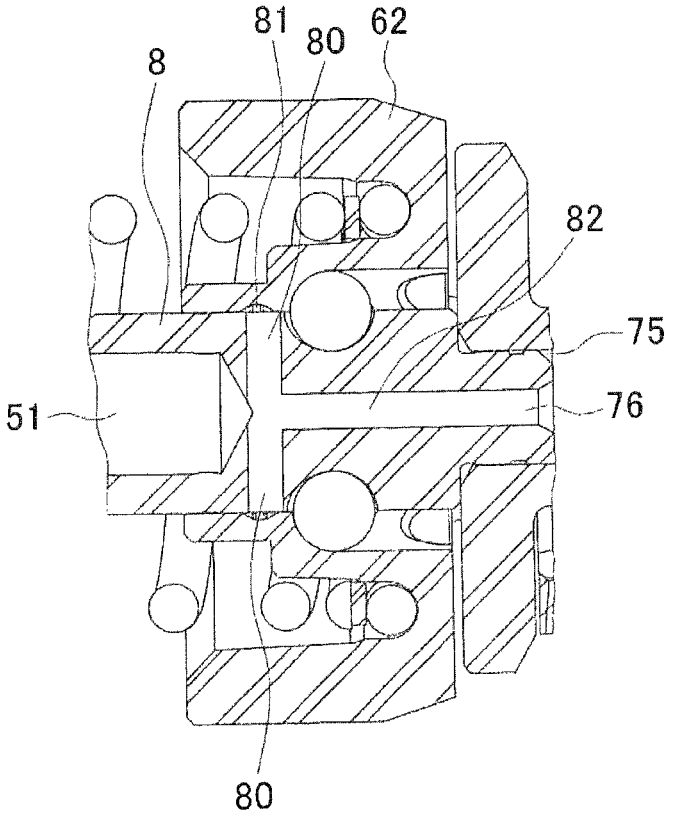
FIG. 9 illustrates an example of a grease supply path according to a modification.

In addition, as illustrated in FIG. 9, a through hole 82 penetrating the axis of the spindle 8 may be formed to communicate between the bottomed hole 51 and the front bottomed hole 76, and the grease supply paths 80 may be provided to extend orthogonally from the through hole 82. In this case, grease is supplied from both front and rear sides of the spindle 8, which leads to a reduction in weight of the spindle 8. Grease having reached the fitting hole 75 of the anvil 10 flows around a front end of the spindle 8 to reach the inner peripheral portion of the hammer 62 through the through hole 82. Therefore, the grease supply paths 80 of the spindle 8 may be omitted.

Figure 10:
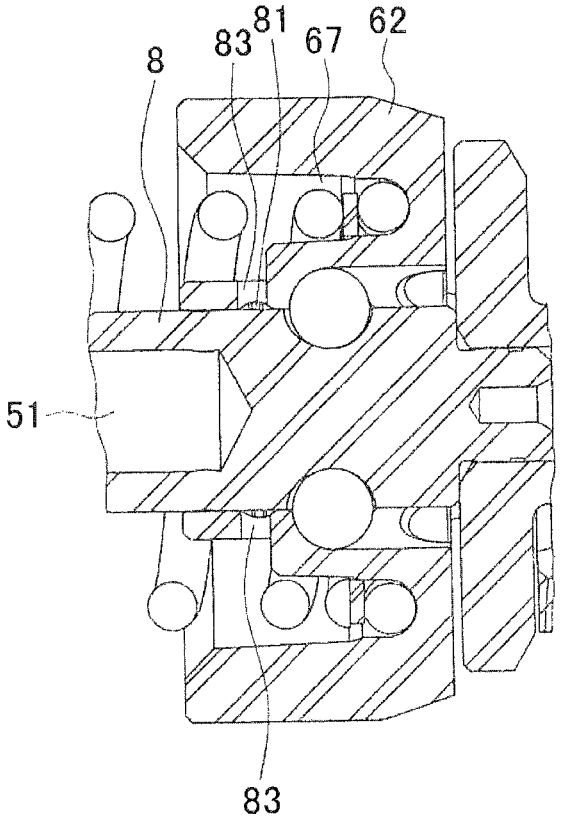
FIG. 10 illustrates an example of a grease supply path according to a modification.

The grease supply paths are not necessarily formed in the spindle 8. It is also conceivable that as illustrated in FIG. 10, grease supply paths 83 are formed in the hammer 62 and orthogonally to the spindle 8, and communicate between the groove 67 of the hammer 62 and the inner peripheral portion of the hammer 62.

In each embodiment, three or more grease supply paths or only one grease supply path may be provided rather than a pair of grease supply paths. The recessed groove 81 of the hammer 62 may be dispensed with.

Figure 11B:
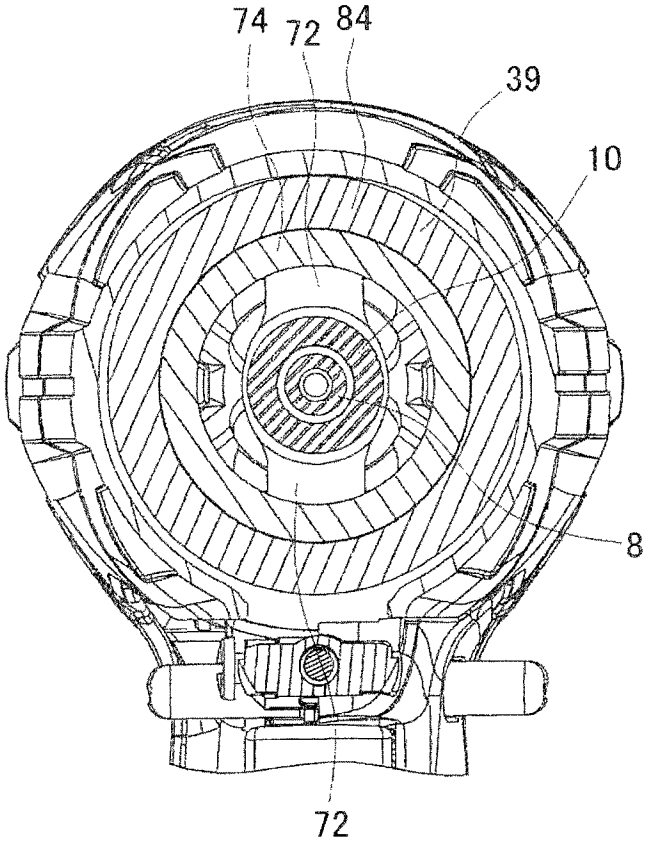
Figure 11A:
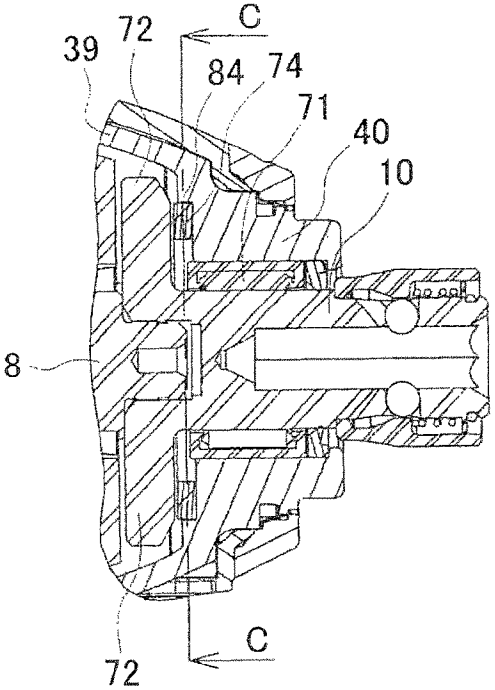

The washer 74 receiving the arms 72 of the anvil 10 is not necessarily held by the holding portion 73 projecting from the inner periphery at a rear end of the front tube portion 40. As illustrated in FIG. 11A, a stepped portion 84 may be formed on an outer side at the rear end of the front tube portion 40, and an outer surface of the washer 74 may be fitted with an inner side of the stepped portion 84 to hold the washer 74.

Figure 12B:
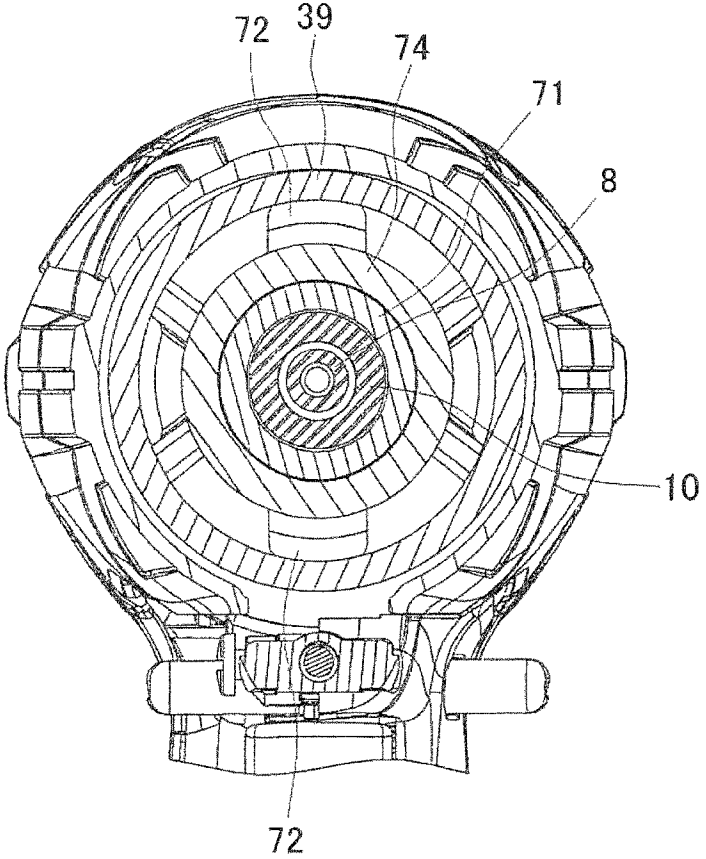
Figure 12A:
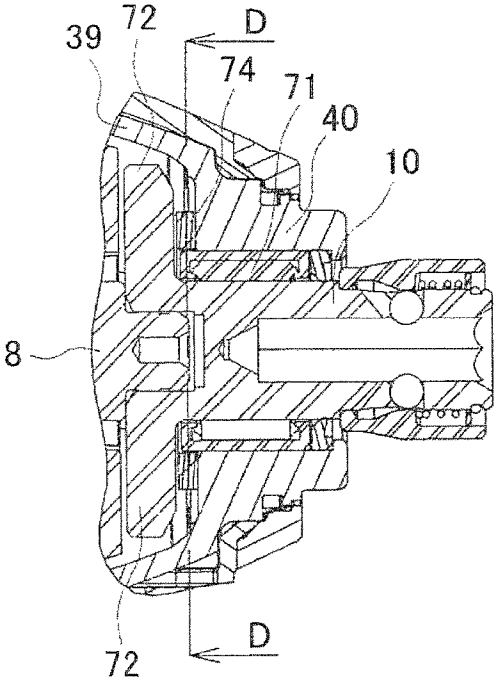

The washer 74 is not necessarily held utilizing the holding portion or the stepped portion. As illustrated in FIG. 12, a rear end of the bearing 71 may be projected rearward with respect to a rear end surface of the front tube portion 40 of the hammer case 39 by elongating the bearing 71 or displacing the bearing 71 rearward, and the washer 74 may be fitted with the bearing 71 for positioning. In this case, the shape of the hammer case 39 is simplified compared to those in FIGS. 1, 11A and 11B, an axial length of the anvil 10 can be shortened while a structure that allows the anvil 10 to rotate with high accuracy is maintained.

Figure 13:
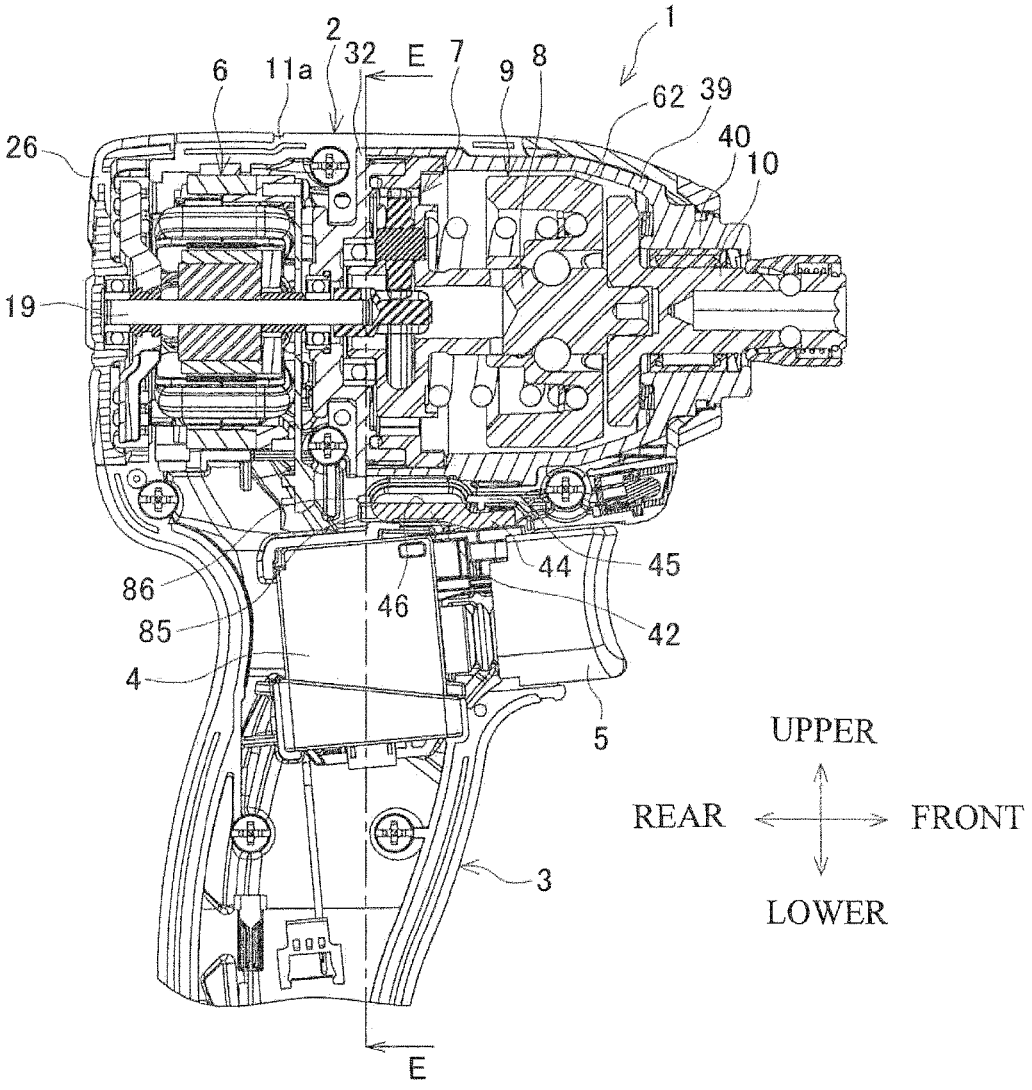
FIG. 13 is a partial vertical sectional view illustrating an example of a forward/reverse switching lever guiding structure according to a modification.
Figure 14:
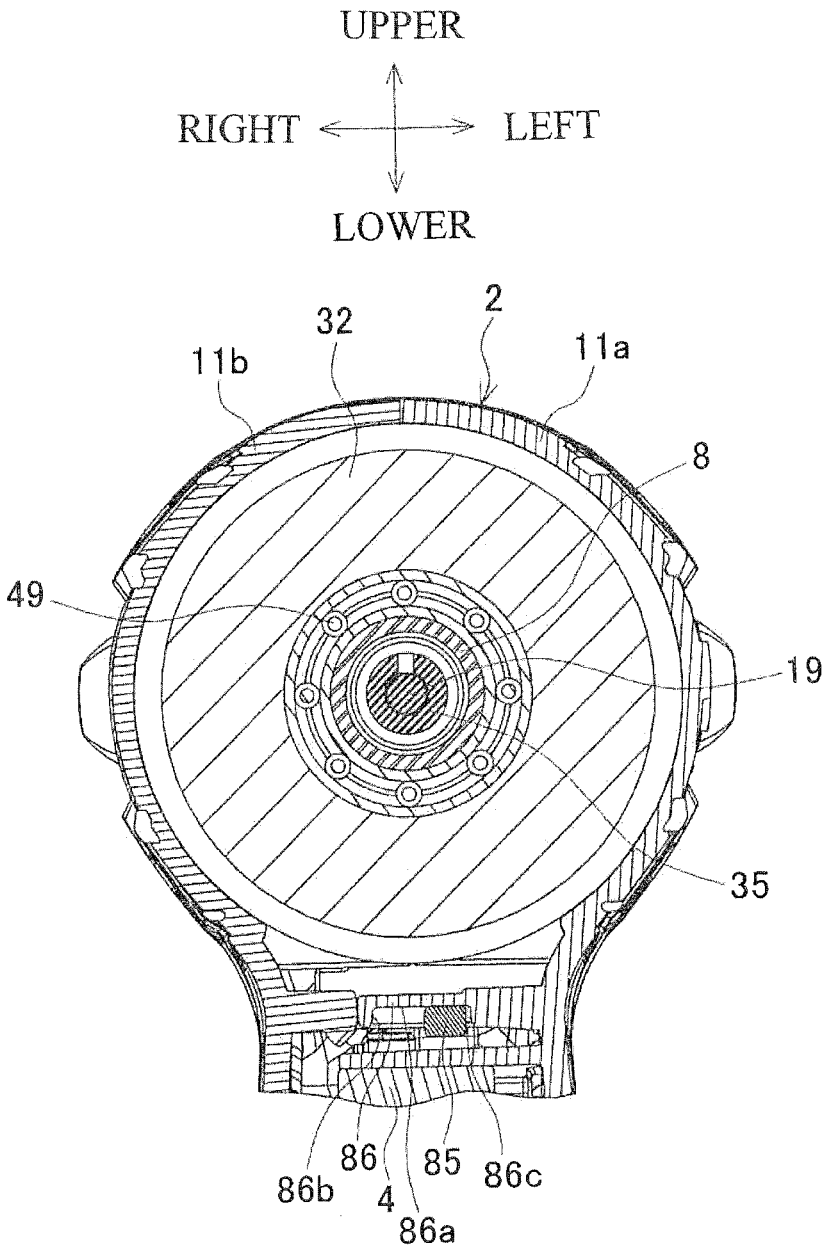
FIG. 14 is a cross-sectional view taken along line E-E in FIG. 13.

As illustrated in FIGS. 13 and 14, the guiding structure for the forward/reverse switching lever 42 may also be achieved by providing a projection 85 to project from the center of a rear surface of the forward/reverse switching lever 42, and sliding the forward/reverse switching lever 42 with the projection 85 contacting a lower surface of a guide piece 86 integrally provided to project from the half housing 11*a*. In the example, the projection 85 is fitted in a recessed portion 86*a* provided in the lower surface of the guide piece 86, and a right wall 86*b* and a left wall 86*c* in the recessed portion 86*a* serve as right and left stoppers for the forward/reverse switching lever 42.

This improves the left-right slidability of the forward/reverse switching lever 42, which is made compact with the notched portion 46 formed at the center of the upper surface of the forward/reverse switching lever 42.

The forward/reverse switching lever 42 may be arranged to overlap the lower surface of the hammer case 39 in the left-right direction.

Due to such structures, the following configurations are also considered to fall within the present invention:

(1) a configuration in which a needle bearing is disposed on an inner peripheral side of a washer;

(2) a configuration in which a forward/reverse switching lever is guided by a front part and/or a rear part of a housing;

(3) a configuration in which a guide portion for a forward/reverse switching lever is provided below a projection of a hammer case; and/or (4) a configuration in which an engagement projection of a forward/reverse switching lever is guided.

The electric power tool is not limited to an impact driver, and the present invention may also be applied to other impact tools, such as an impact wrench, that include an impact mechanism with a hammer. The inventions according to (2) and (4) may also be applied to electric power tools such as a driver drill.

It is explicitly stated that all features disclosed in the description and/or the claims are intended to be disclosed separately and independently from each other for the purpose of original disclosure as well as for the purpose of restricting the claimed invention independent of the composition of the features in the embodiments and/or the claims. It is explicitly stated that all value ranges or indications of groups of entities disclose every possible intermediate value or intermediate entity for the purpose of original disclosure as well as for the purpose of restricting the claimed invention, in particular as limits of value ranges.

What is claimed is:

1. An impact tool comprising:

a motor;

a spindle rotated by the motor;

a hammer that is movable forward and rearward with respect to the spindle;

an anvil struck in a rotational direction by the hammer;

a hammer case housing the spindle and the hammer, the hammer case having a forward end wall with a rearward facing surface, the anvil extending through an opening in the forward end wall;

a bearing disposed in the opening and rotatably supporting the anvil; and a washer disposed between the anvil and the rearward facing surface, wherein:

a radially outer side of the rearward facing surface has a stepped portion extending rearward, and a radially outer surface of the washer is fitted with a radially inward facing side of the stepped portion such that the radially inward facing side of the stepped portion contacts the radially outer surface of the washer, wherein the bearing projects rearward from the rearward facing surface of the forward end wall and the washer overlaps the bearing along an axial direction of the anvil, and wherein a radially inner surface of the washer is spaced radially outward from a radially outer surface of the bearing.

2. The impact tool according to claim 1, wherein the bearing is a needle bearing.

3. The impact tool according to claim 1, wherein the anvil includes a pair of arms configured to be engaged with the hammer in the rotational direction.

4. The impact tool according to claim 3, wherein the washer receives the pair of arms of the anvil.

5. The impact tool according to claim 1, wherein a radially inner surface of the washer is spaced radially outward from a radially outer surface of the bearing.

6. The impact tool according to claim 1, wherein the washer is a resin washer.

7. The impact tool according to claim 1, wherein the washer and the bearing are located on a cross-section that is perpendicular to the anvil.

8. The impact tool according to claim 1, wherein an inner diameter of the washer is greater than an outer diameter of the bearing.

9. The impact tool according to claim 1, wherein the radially inner surface of the washer and the radially outer surface of the bearing define an annular gap there between.

10. An impact tool comprising:

a motor;

a spindle rotated by the motor;

a hammer that is movable forward and rearward with respect to the spindle;

an anvil struck in a rotational direction by the hammer;

a hammer case housing the spindle and the hammer, the hammer case having a forward end wall with a rearward facing surface, the anvil extending through an opening in the forward end wall;

a bearing disposed in the opening and rotatably supporting the anvil;

a holding portion projecting rearward from the rearward end face and being radially outward of the bearing; and a washer fitted on a radially outer side of the holding portion, the washer being disposed between the anvil and the rearward facing surface.

11. The impact tool according to claim 10, wherein the bearing is a needle bearing.

12. The impact tool according to claim 10, wherein the anvil includes a pair of arms configured to be engaged with the hammer in the rotational direction.

13. The impact tool according to claim 12, wherein the washer receives the pair of arms of the anvil.

14. The impact tool according to claim 10, wherein the washer is a resin washer.

15. The impact tool according to claim 10, wherein the washer and the bearing are located on a cross-section that is perpendicular to the anvil.

16. The impact tool according to claim 10, wherein the washer is fitted on the radially outer side of the holding portion so that a radially inner surface of the washer contacts the radially outer side of the holding portion.

* * * * *